US005756948A

United States Patent [19]

Husby et al.

[11] Patent Number: 5,756,948

[45] Date of Patent: May 26, 1998

[54] SIDE-IMPACT ELECTRO-MECHANICAL ACCELEROMETER TO ACTUATE A VEHICULAR SAFETY DEVICE

[75] Inventors: Harald Snorre Husby; Carl Thomas Grossi, III, both of Lakeland, Fla.

[73] Assignee: Breed Automotive Technology, Inc., Lakeland, Fla.

[21] Appl. No.: 777,865

[22] Filed: Dec. 31, 1996

[51] Int. Cl.[6] ..... H01H 35/14

[52] U.S. Cl. ..... 200/61.53

[58] Field of Search ..... 200/1 B, 1 R, 200/61.45 R–61.45 M; 307/91, 10.1, 119, 121; 73/1.37–1.39, 485, 514.01, 514.16, 514.29, 514.35, 514.36, 514.38

[56] References Cited

U.S. PATENT DOCUMENTS

| | | | |
|---|---|---|---|
| 3,439,137 | 4/1969 | Green et al. | 200/61.45 |
| 4,948,929 | 8/1990 | Fukushima | 200/61.45 |
| 4,991,682 | 2/1991 | Kuntz et al. | 180/282 |
| 5,005,861 | 4/1991 | Breed et al. | 280/734 |
| 5,010,217 | 4/1991 | Hueniken et al. | 200/61.45 |
| 5,012,050 | 4/1991 | Sewell | 200/61.45 |
| 5,031,931 | 7/1991 | Thuen et al. | 280/735 |
| 5,053,588 | 10/1991 | Bolender | 200/61.45 |
| 5,059,751 | 10/1991 | Woodman et al. | 200/61.45 M |
| 5,098,122 | 3/1992 | Breed et al. | 280/735 |
| 5,123,499 | 6/1992 | Breed et al. | 180/282 |
| 5,206,469 | 4/1993 | Takeda et al. | 200/61.45 |
| 5,231,253 | 7/1993 | Breed et al. | 200/61.45 |
| 5,237,134 | 8/1993 | Thuen et al. | 200/61.45 M |
| 5,322,981 | 6/1994 | Grossi, III et al. | 200/61.45 |
| 5,335,941 | 8/1994 | Föhl | 280/206 |
| 5,393,944 | 2/1995 | Manandhar et al. | 200/61.45 |

*Primary Examiner*—Michael L. Gellner
*Assistant Examiner*—Michael A. Friedhofer
*Attorney, Agent, or Firm*—Lonnie Drayer

[57] ABSTRACT

A side-impact electro-mechanical accelerometer is used in a vehicle to selectively actuate a vehicular safety device such as an airbag when a lateral acceleration force greater than a predetermined threshold level is sensed. A hollow housing is configured to retain an actuator element movable between a first, second and third position at least partially disposed therein when in the first position and a switch assembly including a first flexible conductive switch element movable between a first, second and third position disposed to engage and normally retain the actuator element when in the first position, a second conductive switch element disposed in spaced relationship relative to the actuator element and the first flexible conductive switch element when each is in the first position to engage the first flexible conductive switch element when the actuator element moves from the first position to the second position when the lateral acceleration force greater than a first predetermined threshold level is exerted on the side-impact electro-mechanical accelerometer to close a first electric circuit and a third flexible conductive switch element disposed in spaced relationship relative to the actuator element and the first and second flexible conductive switch elements when each is in the first or second positions to engage the second flexible conductive switch element when the actuator element moves from the first position to the third position when the lateral acceleration force greater than a second predetermined threshold level is exerted on the side-impact electro-mechanical accelerometer to close a second electric circuit.

51 Claims, 8 Drawing Sheets

SIDE-IMPACT ELECTRO-MECHANICAL ACCELEROMETER TO ACTUATE A VEHICULAR SAFETY DEVICE

BACKGROUND OF THE INVENTION

1. Field of the Invention

The present invention relates to a side-impact accelerometer to detect sudden changes in the lateral acceleration of a motor vehicle and actuate a motor vehicle safety device when the rate of change in the lateral velocity of the motor vehicle exceeds a predetermined threshold level.

Airbag passive restraint systems for protecting vehicle occupants in frontal collisions have been incorporated into most new vehicles by manufacturers. These airbag systems are primarily designed to protect occupants in frontal impacts. Many people, however, are killed or seriously injured in side-impacts, which typically involve one vehicle running into the side of a second vehicle.

Approximately one quarter of all injury producing accidents are side-impacts in which the direction of the force was determined to be within 45 degrees of the lateral axis of the vehicle. According to the National Highway Safety Council of the National Highway Traffic Safety Administration, approximately 20% of all vehicular fatalities are caused by physical contact with interior side surfaces as compared to approximately 70% of vehicular fatalities caused by physical contact with frontal surfaces which include the steering wheel, windshield frame, instrument panel, and windshield. Since airbags have been largely successful in alleviating injuries from frontal impacts, it is important now to focus on the next greatest danger, side-impacts.

2. Description of the Prior Art

Most research and development in accelerometer technology has been directed to frontal impact accelerometers. Generally, prior art electro-mechanical accelerometers can be categorized into two distinct groups: magnetically biased and spring biased accelerometers.

U.S. Pat. No. 4,948,929 teaches a magnetically biased accelerometer comprising an electrically conductive weight floating in magnetic fluid retained within a case body having permanent magnets attached at opposite ends thereof to create a magnetic field so that when an impulse or force exceeding a predetermined level is exerted on the accelerometer, an inertial force is created that moves the weight toward a pair of contacts protruding inside the case body to generate an output signal.

U.S. 4,991,682 teaches an acceleration sensor having a sensor arrangement which employs several sensors sensitive to different acceleration threshold levels to produce a predetermined logic signal when an acceleration threshold value is exceeded U.S. Pat. No. 5,005,861 teaches a magnetically biased accelerometer for passenger restraint systems including a magnetically biased contacting element that moves toward an upper pair and a lower pair of contact blades when a deceleration force exceeding a predetermined threshold level is sensed. Each upper contact blade is split into parallel sections for redundancy; while, each lower contact blade includes a curved section. When the upper contact blades engage the lower contact blades under the influence of the contacting element, an electrical path is completed and the passenger restraint system is deployed.

U.S. Pat. No. 5,010,217 teaches an inertia switch assembly comprising a non-magnetic enclosure containing an inertial mass and switch contacts which are connected by conductors that become terminals passing through an open end of an enclosure. The housing has an integral shroud surrounding the terminals forming a connector plug to connect with a mating plug structure leading to a circuit controlled by the switch assembly.

U.S. Pat. No. 5,012,050 teaches an inertia switch where a mass subjected to a predetermined velocity change causes one electrical contact to engage and deflect another contact thereby creating a switch closure indicating that the predetermined velocity change has been sensed.

U.S. Pat. No. 5,031,931 teaches a spring biased accelerometer comprising a housing with an inertial element movable in a predetermined path, a spring means for biasing the inertial element in a predetermined direction and a conductive blade. Deceleration causes the inertial element to move along the path causing the spring biasing means, which also serves as an electrical contact, to engage the conductive blade completing an electrical circuit resulting in the deployment of the airbag.

U.S. Pat. No. 5,053,588 teaches an adjustable magnetically biased accelerometer comprising a fluid damped piston that is directed upon a predetermined velocity change towards electrical contacts that are respectively connected to a pair of electrical leads. Upon contact of the piston with the electrical contacts, an electrical circuit or path is formed.

U.S. Pat. No. 5,098,122 teaches a spring biased accelerometer comprising a housing with an inertial element movable in a predetermined path, a coiled spring means for biasing the inertial element in a predetermined direction and a pair of conductive blades. Preferably, the coiled spring means is integral with one of the conductive blades whereby the need for a separate contact is eliminated. Deceleration causes the inertial element to move along the path causing the pair of conductive blades to come into contact resulting in the deployment of the airbag.

U.S. Pat. No. 5,123,499 teaches a magnetically biased accelerometer for sensing velocity in a passenger restraint system comprised of a contact element or mass ball and four contact blades consisting of an upper pair and a lower pair. When a deceleration force exceeding a threshold level is sensed, the mass ball forces the upper pair of contact blades into engagement with the lower pair of contact blades to complete an electrical circuit that results in the deployment of the passenger restraint system.

U.S. Pat. No. 5,206,469 teaches a magnetically biased accelerometer consisting of a magnet, a sensing mass attractable by the magnet, a sleeve restricting the movement of the sensing mass in one direction, a pair of strips inclined to slant toward the sensing mass, and a body fitted with the magnet and housing the sensing mass, the sleeve and the contact. Upon a crash, the sensing mass comes into contact with the strips which completes an electrical circuit which releases the airbag.

U.S. Pat. No. 5,231,253 teaches side-impact sensors and strategies for using these sensors. The sensor comprises a housing, an inertial mass movable within the housing, and a first and second contact means responsive to the motion of the inertial mass upon acceleration of the housing in excess of a predetermined threshold value.

U.S. Pat. No. 5,322,981 teaches a velocity change sensor with a cylindrical magnet comprising a magnetically biased contact element arranged to move toward at least one pair of contact blades when a deceleration force exceeding a threshold level is sensed so that an electrical path is established between the blades by the contact element.

U.S. Pat. No. 5,335,941 teaches a spring biased deceleration sensor including an inertial mass ball disposed on a contact spring under a predetermined bias such that when a deceleration force exceeds a certain threshold, the biasing force of the contact spring is overcome, setting the inertial body in motion which deflects the contact spring to a second contact so that the pair form an electrical path or circuit.

U.S. Pat. No. 5,393,944 teaches a deceleration sensor with a base supporting a flexible oscillating one piece plastic mass unit which is pivotable from an unactuated position to an actuated position when the mass unit is subjected to a deceleration of at least a predetermined magnitude.

Despite these numerous efforts, the prior art is seriously deficient in its ability to effectively sense lateral acceleration force in side-impact collisions The present invention provides an inexpensive, reliable accelerometer appropriate for detecting lateral acceleration of vehicles.

SUMMARY OF THE INVENTION

For frontal impact detection, accelerometers are typically located at least eight to twelve inches from the front of a vehicle and are therefore not readily affected by minor frontal impacts. In addition, the passenger compartment is typically a minimum of five feet from the front of a vehicle such that there is sufficient time to deploy an airbag prior to a physical intrusion into the passenger compartment. In contrast, in side-impacts, there is far less distance between the side of the vehicle and the passenger compartment thereby providing for far less time to deploy an airbag. Consequently, a side-impact accelerometer is typically placed as close to the impact zone as possible to provide for optimal sensing and airbag deployment capability. However, this increased sensitivity allows for inadvertent deployment due to minor side-impacts such as from shopping carts and extending vehicle side doors. An accelerometer with the capability to prevent inadvertent deployment while providing optimal functionality is desirable.

To design an accelerometer for side-impacts, the side-intrusion characteristics of a vehicle must be fully analyzed. Since most side-impact accidents involve one vehicle impacting a second vehicle, consideration of this type of car-to-car crash is essential for the design of a side-impact accelerometer.

The physical reaction of a side-door panel in response to a collision is critical in determining the desired characteristics and placement of a side-impact accelerometer. The velocity of the side-door panel of a struck vehicle increases immediately after the impact to a maximum velocity comparable to the velocity of the colliding vehicle. This rapid rise in velocity can happen within five to ten milliseconds. The passenger compartment experiences a relatively small velocity change during this initial stage of the crash. The difference in velocity between the side-door and the passenger compartment manifests itself in physical damage to the struck vehicle. As the side of the vehicle stiffens in the deep post-buckling stage, the resistance force increases and starts to decelerate the side-door panel until finally the side-panel and the passenger compartment reach a common velocity. The critical limitation to gauge in the design of a side-impact accelerometer is the time when the occupant is hit by the side-door inner panel. The deciding factors that influence this time are the stiffness and weights of the vehicles, the angle and location of the impact, the speed of the vehicles, and the distance between the occupant and the side-panel in the struck vehicle A side-impact accelerometer must trigger the airbag and the airbag must deploy before the occupant is hit by the side-door panel.

Considering all critical limitations and variables, an accelerometer for sensing side-impacts must be placed on the side-door panels to be effective. This location is essential since it is sensing the velocity change of the portion of the vehicle which will eventually strike the occupant. To ensure the effectiveness of sensing, it is reasonable that more than one sensor be used for side-impact sensing. For example, considering a four door vehicle, one sensor would be located at each back side-door, one at each front side-door, and one at each center beam of the side-doors. By utilizing multiple accelerometers, inadvertent deployment of an airbag can be avoided while assuring that for all side crashes in which the protection apparatus is needed, the airbag will deploy. For instance, the sensing system can be implemented in such a manner that the airbag will not deploy without a concurrent electric signal from at least two accelerometers. Minor collisions that directly impact one accelerometer will therefore not deploy the airbag. However, if the side-door is not hit directly but deployment of an airbag is nonetheless desirable, the side-impact electromechanical accelerometer must have the ability to sense delayed and stretched pulses propagated to the side-door by the collision in addition to pulses generated in a direct side-door impact. In order to produce concurrent electrical signals for non-direct lateral collisions, the side-impact electro-mechanical accelerometer must be more sensitive to these longer, stretched pulses and have longer contact dwell times.

For added sensitivity, it is desirable for a side-impact accelerometer to include a safing level and a discriminating level. For frontal impact detection, velocity-type low-bias accelerometers located in the passenger compartment are used for safing purposes. In side-impact crashes, however, the crash pulse in the passenger compartment does not provide sufficient data at the time when a side-impact accelerometer is required to trigger. Therefore, it is difficult to use a passenger-compartment safing sensor for a side-impact sensing system. By strategically utilizing multiple accelerometers each with safing and discriminating ability, inadvertent deployment can be avoided while assuring reliability. Additionally, the lower threshold for initiation of the safing electrical signal will provide for detection pulse waves from non-direct side-impacts. The side-impact system can be organized in such a manner that an airbag will deploy only upon the concurrent receipt of at least a safing electrical signal and a discriminating electrical signal.

There is provided in accordance with the present invention a side-impact electro-mechanical accelerometer to sense sudden changes in the lateral acceleration of a vehicle and to produce an electrical signal to actuate a vehicular safety device such as an airbag in response to such sudden changes.

There is further provided in accordance with the present invention a dual threshold side-impact electro-mechanical accelerometer with a safing level and a discriminating level to minimize the chance of inadvertent airbag deployment.

There is further provided in accordance with the present invention a side-impact electro-mechanical accelerometer which incorporates a geometric design to increase closure dwell time.

BRIEF DESCRIPTION OF THE DRAWINGS

Similar reference characters refer to similar parts throughout the several views of the drawings.

DETAILED DESCRIPTION OF THE INVENTION

Figure 1:
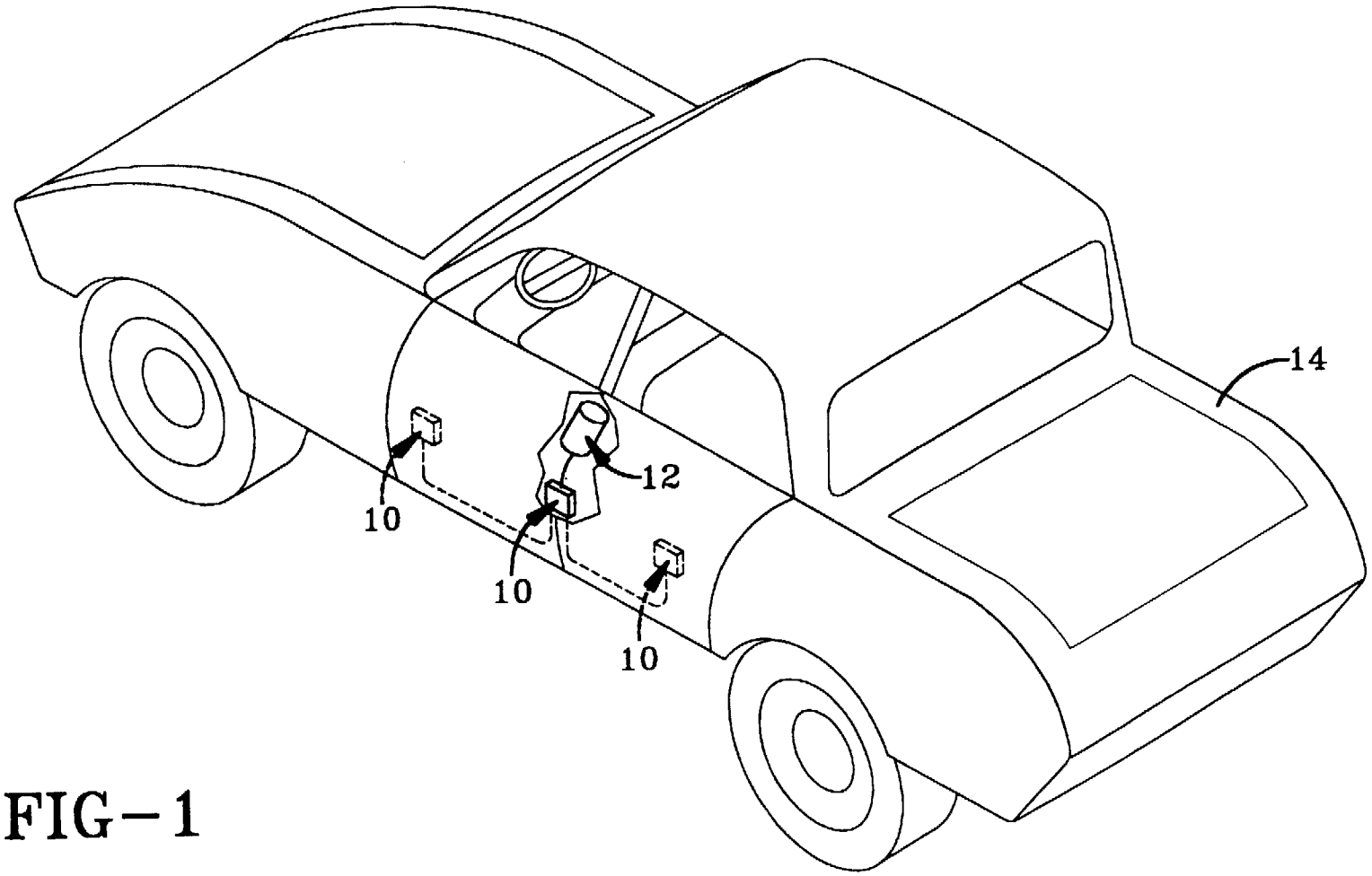
FIG. 1 is a perspective view of a vehicle equipped with the side-impact electro-mechanical accelerometer of the present invention.
Figure 2:
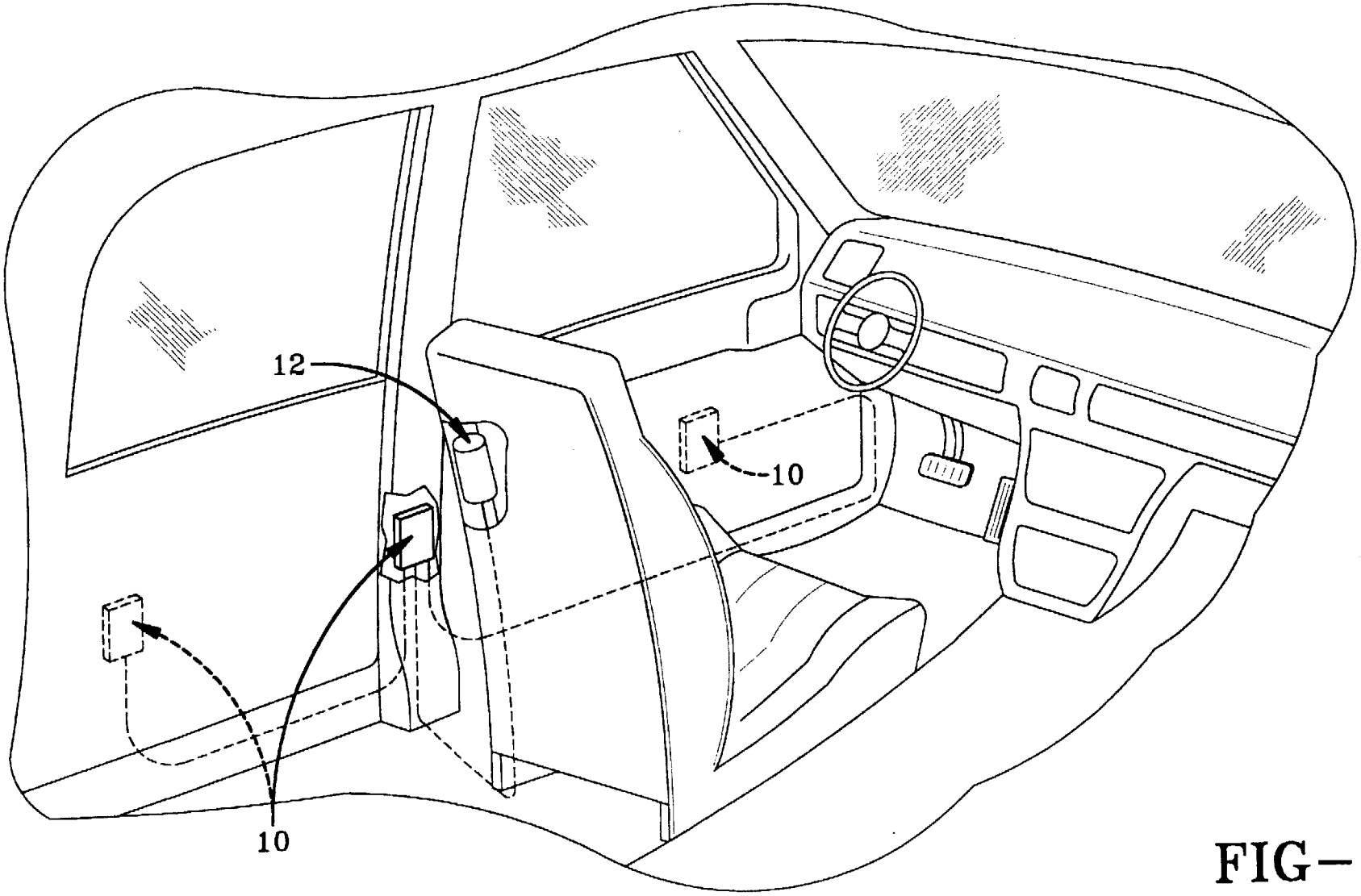
FIG. 2 is a partial detailed perspective view of the interior of the vehicle with the side-impact electro-mechanical accelerometer of the present invention.

As shown in FIG. 1, the present invention relates to a side-impact electro-mechanical accelerometer generally indicated as 10 employed to selectively actuate at least one safety device generally indicated as 12 such as an airbag installed in a vehicle 14. As shown in FIG. 2, at least one accelerometer 10 is strategically placed in every side-door panel and side-door beam. The safety device 12 is stored for example in the side-door beam, the passenger seat backrest or any other suitable location. Upon the accelerometer sensing a lateral acceleration greater than a predetermined threshold level, the safety device 12 deploys and prohibits the vehicle occupant from coming into contact with the intruding side-door panel. As described more fully hereinafter, the side-impact electro-mechanical accelerometer 10 may comprise a damped ball-in-cylinder embodiment or a non-damped ball-on-track embodiment.

Figure 3:
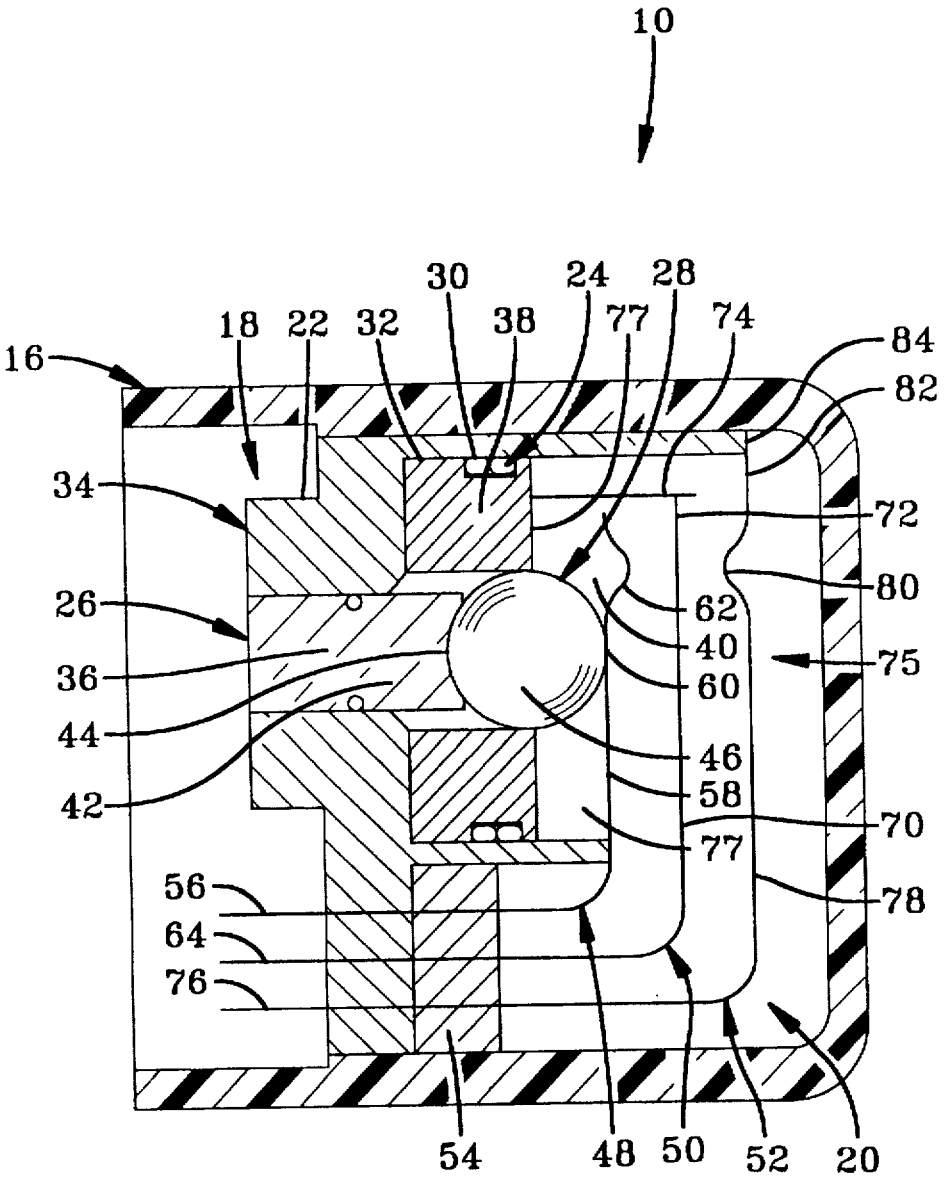
FIG. 3 is a cross-sectional side view of the side-impact electro-mechanical accelerometer of the present invention in the first configuration with an open circuit.
Figure 4:
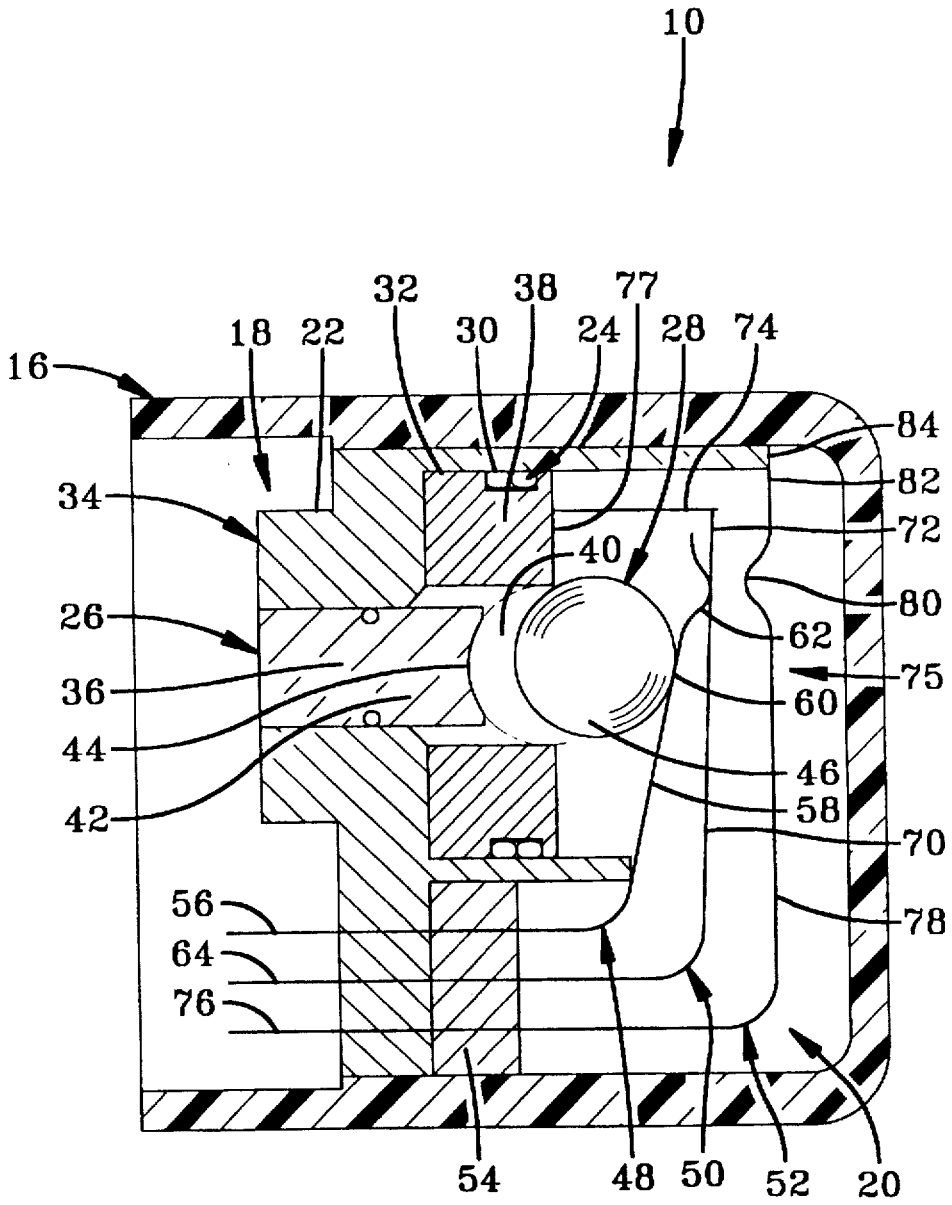
FIG. 4 is a cross-sectional side view of the side-impact electro-mechanical accelerometer of the present invention in the second configuration with a closed circuit.
Figure 5:
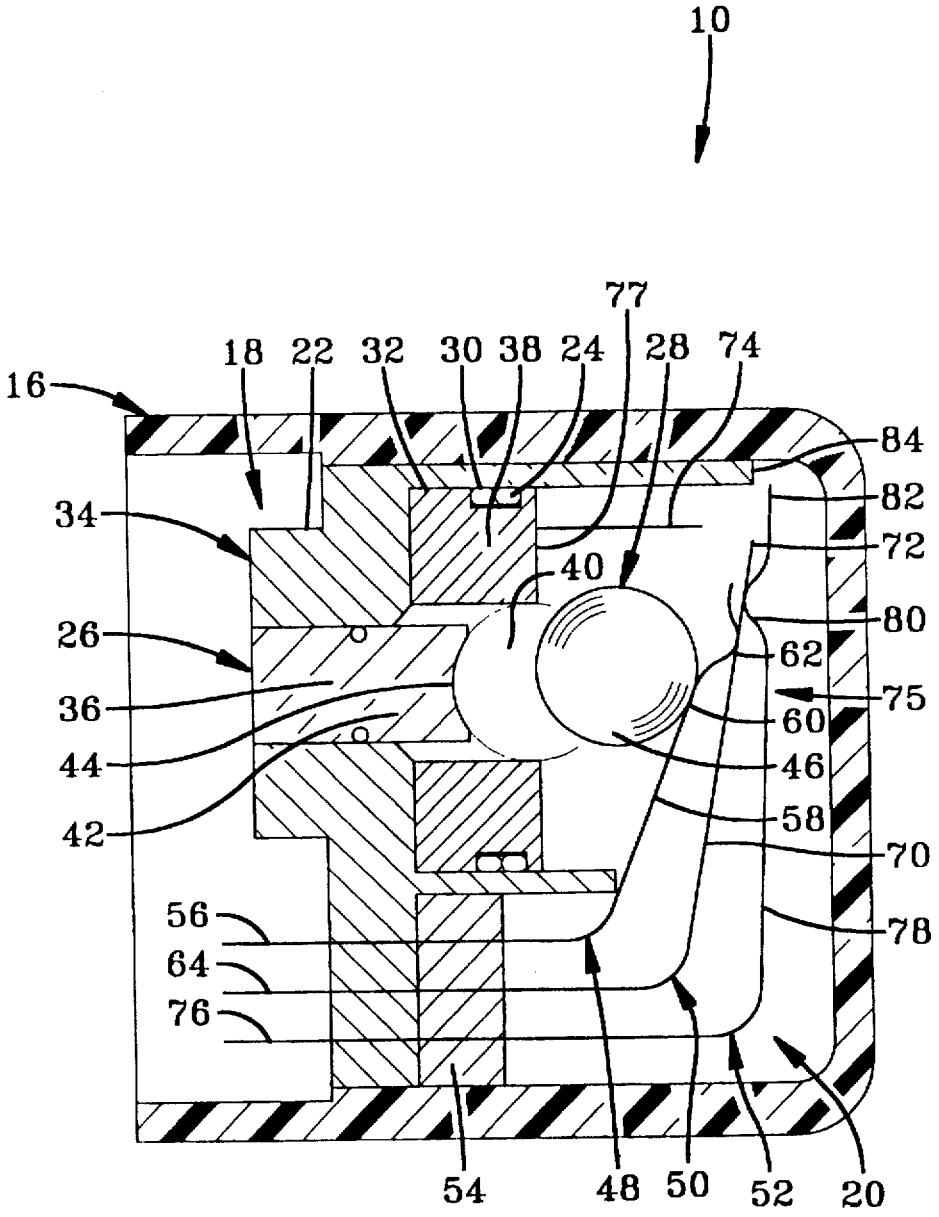
FIG. 5 is a cross-sectional side view of the side-impact electro-mechanical accelerometer of the present invention in the third configuration with a closed circuit.

A damped ball-in-cylinder embodiment is shown in FIGS. 3, 4 and 5. Specifically, the side-impact electro-mechanical accelerometer 10 comprises an outer hollow housing generally indicated as 16 configured to maintain an actuator means generally indicated as 18 in operative relationship relative to a switch means generally indicated as 20 therein. As discussed more fully hereinafter, the actuator means 18 which is selectively operative in a first, second and third actuator configuration and the switch means 20 which is selectively operative in a first, second and third switch configuration cooperate to supply an electrical signal from an external electrical source (not shown) to actuate at least one safety device 12 when the actuator means 18 and the switch means 20 are in the second or third actuator configurations and the second or third switch configurations respectively.

The actuator means 18 comprises a substantially tubular member 22 which contains an actuator damping means and an actuator adjustment means generally indicated as 24 and 26 respectively and an actuator generally indicated as 28 movable between a first, second and third position in operative relationship relative to the actuator damping means 24 and the actuator adjustment means 26 when in the first position. The substantially tubular member 22 comprises an inner end portion 30 having a substantially annular recess 32 formed therein to retain the actuator damping means 24 and an outer end portion 34 having a substantially cylindrical channel 36 formed therein to retain the actuator adjustment means 26 therein. The actuator damping means 24 comprises a substantially annular damping member 38 securely disposed within the substantially annular recess 32 of the inner end portion 30 of the substantially tubular member 22 having a substantially annular damping aperture 40 formed therethrough to receive at least a portion of the actuator 28 therein when the actuator 28 is in the first position. The actuator adjustment means 26 is preferably a stopper comprising an actuator seat member 42 including a concave seat 44 disposed to engage the actuator 28 when in the first position and longitudinally adjustable within the substantially cylindrical channel 36 to adjust the distance of travel of the actuator 28 from the first position to the second position and from the second position to the third position to control the actuation time or time between a collision and the actuation of the safety device 12 for any particular G force exerted on the vehicle 14. The actuator 28 comprises a substantially spherical member 46 having a diameter substantially equal to the diameter of the substantially annular damping aperture 40 to minimize oscillation or lateral movement of the actuator 28 within the substantially annular damping aperture 40.

The switch means 20 comprises a first, second and third flexible conductive switch element generally indicated as 48, 50 and 52 respectively held in operative position relative to each other by a switch mounting bracket 54 disposed within the outer hollow housing 16. The first flexible conductive switch element 48 movable between a first, second, and third position comprises a first proximal substantially horizontal conductive section 56 held in operative position by switch mounting bracket 54 and electrically connected to an external electrical source (not shown) and a first distal substantially straight flexible substantially vertical conductive section 58 extending between the switch mounting bracket 54 and the actuator 28 terminating in camming contact section 60 followed by an arcuate or concave contact element 62. The first distal substantially straight flexible substantially vertical conductive section 58 physically guides the actuator 28 between the first and second positions.

The second flexible conductive switch element 50 movable between a first, second and third position comprises a second proximal substantially horizontal conductive section 64 held in operative relationship by switch mounting bracket 54 and electrically connected to the external electrical source (not shown) and a second distal substantially straight flexible substantially vertical conductive section 70 disposed in spaced relationship relative to the concave contact element 62 of the first flexible conductive switch element 48 and the actuator 28 when each is in the first position to form an open circuit. The end portion 72 of the second distal substantially straight flexible substantially vertical conductive section 70 engages a first stop or limit 74 formed on the inside of the housing 16. The third flexible conductive switch element 52 comprises a third proximal substantially horizontal conductive section 76 held in operative relationship by switch mounting bracket 54 and electrically connected to the external electrical source (not shown) and a third distal substantially straight flexible substantially vertical conductive section 78 including an arcuate or convex contact element 80 normally disposed in spaced relationship relative to the second distal substantially straight flexible substantially vertical conductive section 70. The end portion 82 of the third distal substantially straight flexible substantially vertical conductive section 78 engages a second stop or limit 84 formed on the inner end portion 30 of the substantially tubular member 22.

As shown in FIG. 3, the camming contact section 60 of the first distal substantially straight flexible substantially vertical conductive section 58 of the first flexible conductive switch element 48 normally biases the actuator 28 against the actuator adjustment means 26 or concave seat 44 of the actuator seat member 42 to maintain the actuator 28 in the first position. As shown in FIG. 4, the substantially arcuate or concave contact element 62 of the first distal substantially straight flexible substantially vertical conductive section 58 of the first flexible conductive switch element 48 engages the second distal substantially straight flexible substantially vertical conductive section 70 of the second flexible conductive switch element 50 when the actuator 28 and the first flexible conductive switch element 48 is each in the second configuration complete an electric circuit.

As shown in FIG. 5, the substantially concave contact element 62 of the first distal substantially straight flexible substantially vertical conductive section 58 and the second distal substantially straight flexible substantially vertical conductive section 70 of the second flexible conductive switch element 50 engages the substantially convex element 80 of the third flexible conductive switch element 52 when the actuator 28 and the first flexible conductive switch element 48 is each in the third configuration complete an electric circuit.

As previously described, the actuator 28 is normally biased in the first position by the first flexible conductive switch element 48 with the second flexible conductive switch element 50 engaging the first stop or limit 74 and the third flexible conductive switch element 51 engaging the second stop or limit 84. So positioned, the electro-mechanical accelerometer 10 is in the first configuration with the actuator 28 and the switch means 20 in the first actuator configuration and first switch configuration respectively. The position of the actuator 28 within the substantially tubular member 22 of the actuator means 18 when in the first position is set by adjusting the actuator adjustment means 26 longitudinally relative to the substantially tubular member 22

The inner end portion 30 of the substantially tubular member 22 and the outer hollow housing 16 cooperatively form an actuation chamber generally indicated as 75 therebetween having a diameter greater than the diameter of the damping aperture 40 and an actuator retention means or retention shoulder 77 to engage and retain the actuator 28 therein when in the second and third positions.

When the side-impact electro-mechanical accelerometer 10 senses a lateral acceleration G force exceeding a first predetermined threshold level such as 7 Gs, the force due to the resulting deceleration causes the actuator 28 to move from the first position to the second position moving the first flexible conductive switch element 48 to the second position to contact with the second flexible conductive switch element 50 as shown in FIG. 4. As the actuator 28 moves from the first position (FIG. 3) to the second position (FIG. 4) outside the substantially annular damping aperture 40 or the substantially tubular member 22, camming contact section 60 and the concave contact element 62 of the first flexible conductive switch element 48 guide the actuator 28 against the retention shoulder 77. Retention of the actuator 28 within the actuator chamber 75 by the retention shoulder 77 and the first conductive switch element 48 increases the dwell time or the time in which the electrical circuit is complete during high G force collisions. This increased dwell time allows for a stronger electrical current to be produced resulting in a more reliable side-impact electro-mechanical accelerometer 10 during high G force collisions. So positioned, the side-impact electro-mechanical accelerometer 10 is in the second configuration with the actuator means 18 and the switch means 20 in the second actuator configuration and second switch configuration respectively, with the first and second proximal substantially horizontal conduction sections 56 and 64 connected to the electric power source (not shown) to complete an electric circuit.

When the vehicle 14 is involved in a crash resulting in a deceleration G force exceeding a second predetermined threshold level such as 12 Gs, the force due to the resulting deceleration causes the actuator 28 to move from the first position to the third position moving the first and second flexible conductive switch elements 48 and 50 to their third positions to contact with the third flexible conductive switch element 52 as shown in FIG. 5. As the actuator 28 moves from the first position (FIG. 3) to the third position (FIG. 5) outside the substantially annular damping aperture 40 or the substantially tubular member 22, the camming contact section 60 and the concave contact element 62 guide the actuator 28 against the retention shoulder 77. Retention of the actuator 28 within the actuator chamber 75 by the retention shoulder 77 and the first flexible switch element 48 increases the dwell time or the time in which the electrical circuit is complete during high G force collisions. This increased dwell time allows for a stronger electrical current to be produced resulting in a more reliable side-impact electro-mechanical accelerometer 10 during high G force collisions. So positioned, the side-impact electro-mechanical accelerometer 10 is in the third configuration with the actuator means 18 and the switch means 20 in the third actuator configuration and third switch configuration respectively, with the second and third proximal substantially horizontal conductive sections 64 and 76 connected to the electric power source (not shown) to complete another electric circuit.

With the improved geometric design the damped ball-in-cylinder side-impact electro-mechanical accelerometer can obtain a minimum dwell time of 5.0 milliseconds at 300 Gs in response to a 5.0 millisecond pulse as compared to prior art accelerometers which can obtain dwell times of 1.0 milliseconds.

Figure 6:
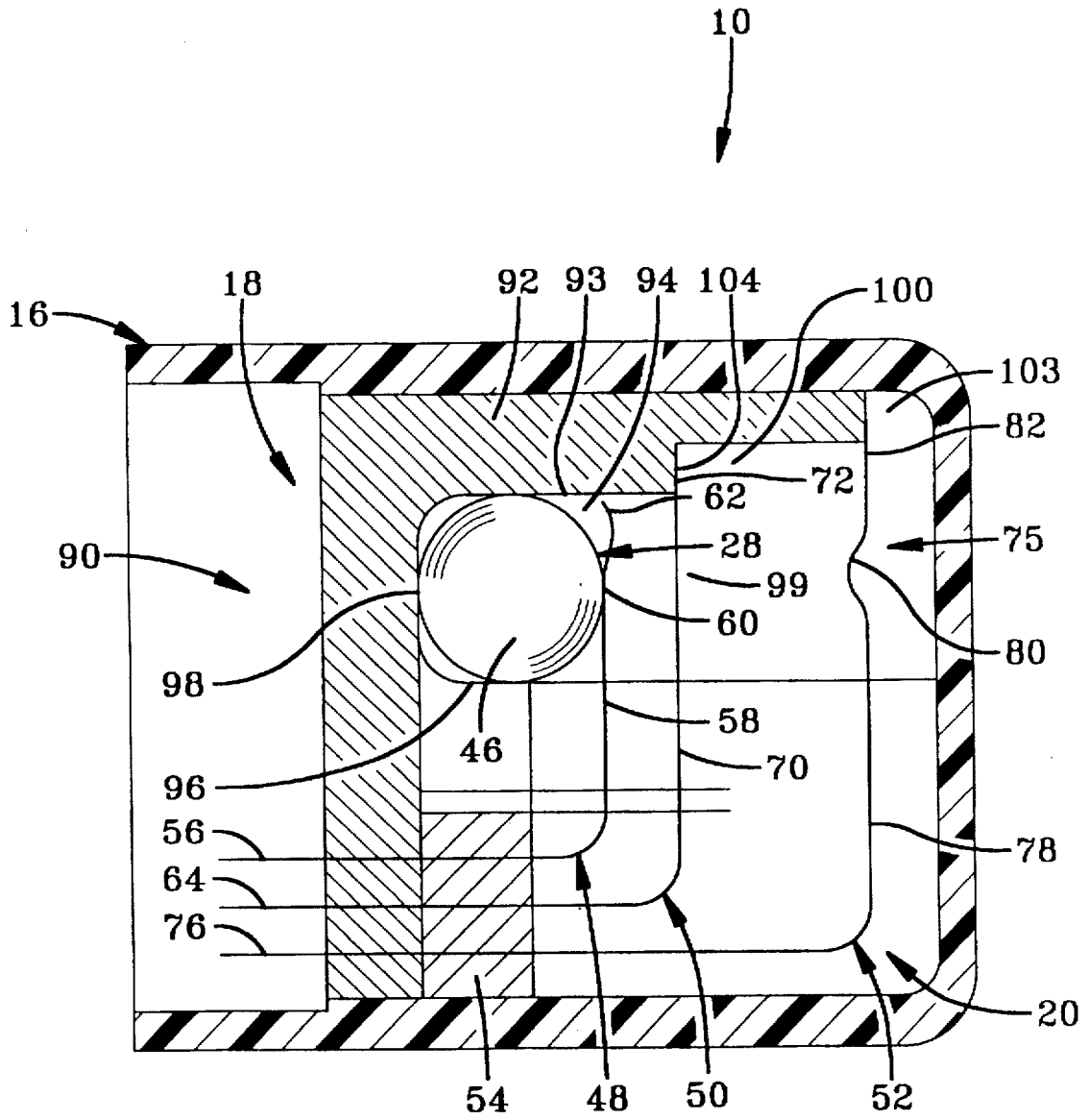
FIG. 6 is a cross-sectional side view of another embodiment of the side-impact electro-mechanical accelerometer of the present invention in the first configuration with an open circuit.
Figure 7:
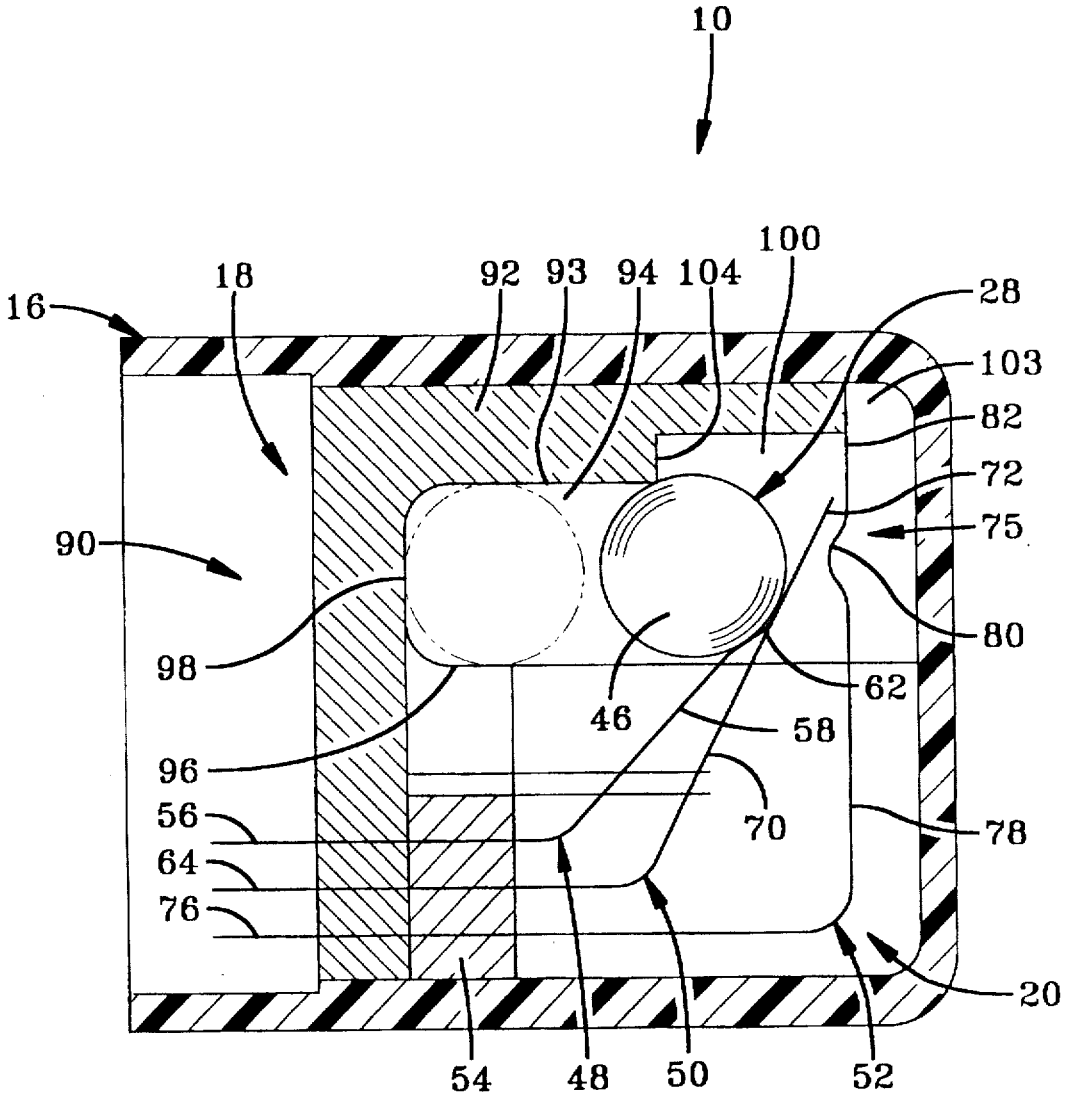
FIG. 7 is a cross-sectional side view of another embodiment of the side-impact electro-mechanical accelerometer of the present invention in the second configuration with a closed circuit.
Figure 8:
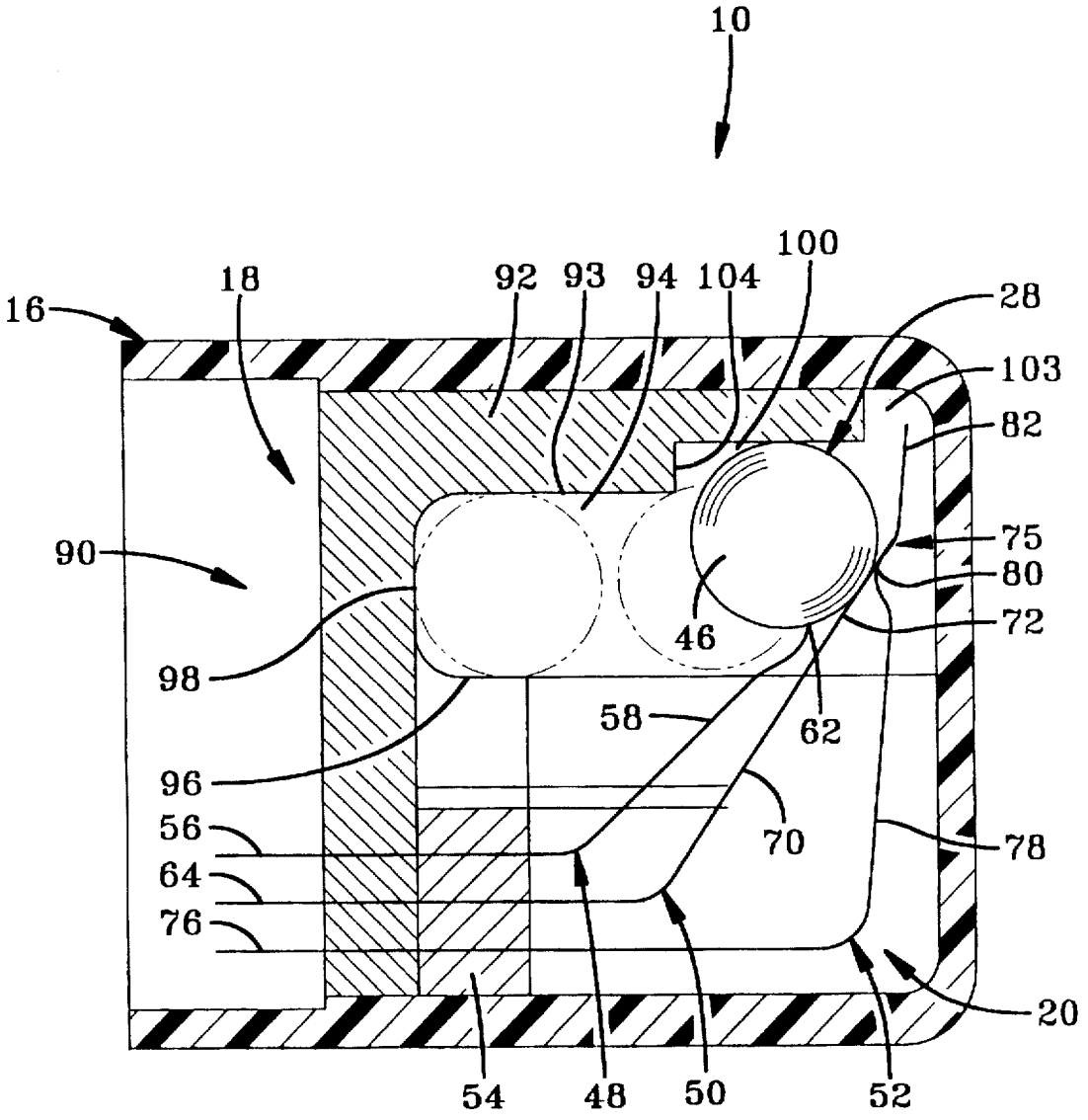
FIG. 8 is a cross-sectional side view of another embodiment of the side-impact electro-mechanical accelerometer of the present invention in the third configuration with a closed circuit.

A non-damped ball-on-track embodiment is shown in FIGS. 6, 7 and 8. The difference between the damped ball-in-cylinder embodiment and the non-damped ball-on-track embodiment is that the substantially tubular member 22 which contains the actuator dampening means 24 and the actuator adjustment means 26 is replaced by a track guiding means generally indicated as 90. In all other respects, the basic functionality of the two embodiments are similar.

More specifically, the side-impact electro-mechanical accelerometer 10 in its non-damped ball-on-track embodiment comprises an outer hollow housing generally indicated as 16 configured to maintain an actuator means generally indicated as 18 in operative relationship relative to a switch means generally indicated as 20 therein. As discussed more fully hereinafter, the actuator means 18 which is selectively operative in a first, second and third actuator configuration and the switch means 20 which is selectively operative in a first, second and third switch configuration cooperate to supply an electrical signal from an external electrical source (not shown) to actuate at least one safety device 12 when the actuator means 18 and the switch means 20 are in the second or third actuator configurations and the second or third switch configurations respectively.

The actuator means 18 comprises an actuator 28 movable between a first, second and third position and a track guiding means 90 which contains a body 92 having an inner end portion 93 wherein a recess 94 is formed to retain a track 96 therein to guide the actuator 28 when moving from the first position to the second and third positions. The track 96 includes a substantially vertical seat 98 disposed to engage the actuator 28 when in the first position and a substantially annular travel aperture 99 to receive at least a portion of the actuator 28 when in the second position. The length of the track 96 can be longitudinally varied within the recess 94 to adjust the distance of travel of the actuator 28 from the first position to the second position and from the first position to the third position to control the actuation time or time between a collision and the actuation of the safety device 12 for any particular G force exerted on the vehicle 14. Similar to the damped ball-in-cylinder embodiments the actuator 28 comprises a substantially spherical member 46 having a diameter substantially equal to the diameter of the substantially annular travel aperture 99 to minimize oscillation or lateral movement of the actuator 28 within the substantially annular travel aperture 99.

The switch means 20 comprises a first, second and third flexible conductive switch element generally indicated as 48, 50 and 52 respectively held in operative position relative to each other by a switch mounting bracket 54 disposed within the outer hollow housing 16 The first flexible conductive switch element 48 movable between a first, second and third position comprises a first proximal substantially horizontal conductive section 56 held in operative position by switch mounting bracket 54 and electrically connected to an external electrical source (not shown) and a first distal substantially straight flexible substantially vertical conductive section 58 extending between the switch mounting bracket 54 and the actuator 28 terminating in camming contact section 60 followed by an arcuate or concave contact element 62. The first distal substantially straight flexible substantially vertical conductive section 58 physically directs the actuator 28 along the track 96 between the first and second positions.

The second flexible conductive switch element 50 movable between a first, second and third position comprises a second proximal substantially horizontal conductive section 64 held in operative relationship by switch mounting bracket 54 and electrically connected to the external electrical source (not shown) and a second distal substantially straight flexible substantially vertical conductive section 70 movable between a first, second and third position disposed in spaced relationship relative to the concave contact element 62 of the first flexible conductive switch element 48 and the actuator 28 when each is in the first position to form an open circuit. The end portion 72 of the second distal substantially straight flexible substantially vertical conductive section 70 engages a first stop or limit 100 formed on the inner end portion 93 of the body 92 of the track guiding means 90.

The third flexible conductive switch element 52 comprises a third proximal substantially horizontal conductive section 76 held in operative relationship by switch mounting bracket 54 and electrically connected to the external electrical source (not shown) and a third distal substantially straight flexible substantially vertical conductive section 78 including an arcuate or convex contact element 80 normally disposed in spaced relationship relative to the second distal substantially straight flexible substantially vertical conductive section 70. The end portion 82 of the third distal substantially straight flexible substantially vertical conductive section 78 engages a second stop or limit 103 formed on the inner end portion 93 of the body 92 of the track guiding means 90.

As shown in FIG. 6, the camming contact section 60 of the first distal substantially straight flexible substantially vertical conductive section 58 of the first flexible conductive switch element 48 normally biases the actuator 28 against the substantially vertical seat 98 of the track 96 to maintain the actuator 28 in the first position. As shown in FIG. 7, the substantially concave contact element 62 of the first distal substantially straight flexible substantially vertical conductive section 58 of the first flexible conductive switch element 48 engages the second distal substantially straight flexible substantially vertical conductive section 70 of the second flexible conductive switch element 50 when the actuator 28 and the first flexible conductive switch element 48 is each in the second position to complete an electric circuit.

As shown in FIG. 8, the substantially concave contact element 62 of the first distal substantially straight flexible substantially vertical conductive section 58 and the second distal substantially straight flexible substantially vertical conductive section 70 of the second flexible conductive switch element 50 engages the substantially convex element 80 of the third flexible conductive switch element 52 when the actuator 28 and the first flexible conductive switch element 48 is each in the third position to complete an electric circuit.

As previously described, the actuator 28 is normally biased in the first position by the first flexible conductive switch element 48 with the second flexible conductive switch element 52 engaging the first stop or limit 100 and the third flexible conductive switch element 52 engaging the second stop or limit 103. So positioned, the electromechanical accelerometer 10 is in the first configuration with the actuator 28 and the switch means 20 in the first actuator configuration and first switch configuration respectively. The position of the actuator 28 on the track 96 of the actuator means 18 when in the first actuator configuration is dependent upon the length of the track 96.

The inner end portion 93 of the body 92 of the track guiding means 90 and the outer hollow housing 16 cooperatively form an actuation chamber generally indicated as 75 therebetween having a diameter greater than the diameter of the substantially annular travel aperture 99. The first stop or limit 100 serves as a retention shoulder 104 to receive and momentarily retain the actuator 28 within the actuation chamber 75 when in the second and third positions.

When the side-impact accelerometer 10 senses a lateral acceleration G force exceeding a first predetermined threshold level such as 7 Gs, the force due to the resulting deceleration causes the actuator 28 to move from the first position to the second position moving the concave contact element 62 of the first distal substantially straight flexible substantially vertical conductive section 58 of the first flexible conductive switch element 48 to the second position to make contact with the second distal substantially straight flexible substantially vertical conductive section 70 of the second flexible conductive switch element 50 as shown in FIG. 7. As the actuator 28 moves from the first position (FIG. 6) to the second position (FIG. 7), the camming contact section 60 and the concave contact element 62 of the first flexible conductive switch element 48 guide the actuator 28 against the retention shoulder 104. Retention of the actuator 28 within the actuator chamber 75 by the retention shoulder 104 and the first flexible conductive switch element 48 increases the dwell time or the time in which the electrical circuit is complete during high G force collisions. This increased dwell time allows for a stronger electrical current to be produced resulting in a more reliable electromechanical accelerometer 10 during high G force collisions.

So positioned, the electro-mechanical accelerometer 10 is in the second configuration with the actuator means 18 and the switch means 20 in the second actuator configuration and second switch configuration respectively, with the first and second proximal substantially horizontal conduction sections 56 and 64 connected to the electric power source (not shown) to complete an electric circuit.

When the vehicle 14 is involved in a crash resulting in a deceleration G force exceeding a second predetermined threshold level such as 12 Gs, the force due to the resulting deceleration causes the actuator 28 to move from the first position to the third position moving the first and second flexible conductive switch elements 48 and 50 to their third positions to contact with the third flexible conductive switch element 52 as shown in FIG. 8. As the actuator 28 moves from the first position (FIG. 6) to the third position (FIG. 8), the camming contact section 60 and the concave contact element 62 of the first flexible conductive switch element 48 guide the actuator 28 against the retention shoulder 104. Retention of the actuator 28 within the actuator chamber 75 by the retention shoulder 104 and the first flexible switch element 48 increases the dwell time or the time in which the electrical circuit is complete during high G force collisions. This increased dwell time allows for a stronger electrical current to be produced resulting in a more reliable electro-mechanical accelerometer 10 during high G force collisions. So positioned, the electro-mechanical accelerometer 10 is in the third configuration with the actuator means 18 and the switch means 20 in the third actuator configuration and third switch configuration respectively, with the second and third proximal substantially horizontal conductive sections 64 and 76 connected to the electric power source (not shown) to complete another electric circuit.

With the improved geometric design, the non-damped ball-on-track side-impact electro-mechanical accelerometer can obtain a minimum dwell time of 5.0 milliseconds at 300 Gs in response to a 5.0 millisecond pulse as compared to prior art accelerometers which can obtain dwell times of 1.0 milliseconds.

The dual-threshold design of the invention in either embodiment provides for a more discriminating accelerometer 10 such that inadvertent or minor collisions will not actuate the safety device 12. Because safety devices such as airbags are single use mechanisms and must be replaced upon each use, it is extremely cost beneficial to prevent inadvertent actuation upon low-impact collisions. The dual threshold design provides for actuation of the safety device 12 only upon detection of a discriminating or second predetermined threshold level. Consequently, direct impacts upon the accelerometer 10 by a shopping cart or extending vehicle side door will at most produce a safing electrical signal which by itself will not deploy the safety device 12. In addition, the dual threshold embodiment allows for multiple uses of the signals produced by the first and second electric circuits of the accelerometer 10. For instance, at each predetermined threshold level, a different safety mechanism can be actuated depending upon the force of the collision and the desired passenger protection Additionally, the strategic arrangement of multiple accelerometers 10 may provide for additional security in that the control device (not shown) can be programmed such that it will actuate the safety device 12 only upon the detection of a safing electrical signal in conjunction with a discriminating electrical signal.

The enhanced closure dwell time of the accelerometer allows for the receipt by the control device (not shown) of two concurrent signals from at least two accelerometers 10. For instance, the enhanced closure dwell time allows a first accelerometer to produce a discriminating electrical signal of sufficient strength such that a second accelerometer can produce a concurrent safing or discriminating electrical signal in response to delayed crash wave pulses.

For an integrated side impact detection system, three accelerometers 10 are strategically positioned on each side of the vehicle 14. Each accelerometer 10 is mounted just inside the sheet metal skin of the vehicle, and attached to a beam or support member. The three accelerometers are wired in parallel. In order for the airbag 12 to be deployed, at least one safing signal and one discriminating signal must be concurrently received by the control device (not shown).

The components of the electro-mechanical accelerometer 10 are insert molded which provide for a minimal amount of components. Unlike in the prior art, the hollow housing 16 is an integrated component of the accelerometer 10 in that it provides a cavity for receiving the actuator 28 upon a collision. The ball-on-track embodiment of FIG. 6 has the additional benefit of having a hollow housing 16 which is plastic. The ability to make the accelerometer largely from plastic with the exception of the conductive switch elements and the actuator makes this accelerometer easy to manufacture and inexpensive to produce. To ensure that the ball-in-cylinder accelerometer 10 of FIG. 3 is hermetically sealed, the metallic parts can first be coated by a bonding material which adheres to both the contacts and the plastic. It is known that the contacts and the plastic have different thermal expansion coefficients and thus, if they are not treated, they could separate when the temperature changes, resulting in leaks.

Another important feature of the disclosed invention is the specific material and shape of the contact blade terminals. The contact blade terminals are bi-metallic thus allowing for each to be crimped onto the output terminals (not shown). This added feature alleviates the need for a pigtail mechanism to connect the contact blade terminals to the output terminals 32. By doing so, this reduces the need for an additional connection thus reducing the possibility of electrical failure Although the invention has been described in its preferred embodiment, it is understood that the present disclosure of the preferred embodiment may be changed in details of construction and the combination and arrangement of elements may be departed from without diminishing the spirit and the scope of the invention as hereinafter claimed.

What is claimed is:

1. A side-impact electro-mechanical accelerometer for use in a vehicle to close a first electric circuit when a lateral acceleration force greater than a first predetermined threshold level is sensed and to close a second electric circuit when a lateral acceleration force greater than a second predetermined threshold level is sensed, comprising: a hollow housing having an actuator means including a member having an aperture formed therein to selectively receive an actuator therein; a chamber cooperatively formed by said hollow housing and said member wherein said actuator means is selectively operable in a first, second and third actuator configuration such that said actuator is at least partially disposed in said housing when in said first actuator; and a switch means including a first conductive switch element movable between a first, second and third position disposed to engage said actuator in a first configuration, a second conductive switch element movable between a first, second and third position disposed in spaced relationship relative to said actuator means and said first conductive switch element in said first configuration and disposed to engage said first conductive switch element in a second configuration when a lateral acceleration force greater than the first predetermined threshold level is exerted on the side-impact electro-mechanical accelerometer to close said first electric circuit and a third conductive switch element movable between a first and second position disposed in spaced relationship relative to the second conductive switch element in said first configuration and disposed to engage the second conductive switch element in said second configuration when a lateral acceleration force greater than the second predetermined threshold level is exerted on the electro-mechanical accelerometer to close said second electric circuit.

2. The side-impact electro-mechanical accelerometer of claim 1 wherein said member includes a recess formed therein to house said actuator means comprising an actuator damping means with said aperture formed therethrough to operatively retain said actuator therein when in said first configuration.

3. The side-impact electro-mechanical accelerometer of claim 2 wherein said actuator means further comprises an actuator adjustment means to longitudinally adjust the position of said actuator within said member when said actuator is in said first configuration.

4. The side-impact electro-mechanical accelerometer of claim 3 wherein said actuator adjustment means comprises an actuator seat member to engage said actuator when in said first configuration.

5. The side-impact electro-mechanical accelerometer of claim 4 wherein the actuator seat member includes a concave seat which engages the actuator when in said first configuration.

6. The side-impact electro-mechanical accelerometer of claim 2 wherein said member is substantially tubular and comprises an inner end portion having said recess formed therein to retain said actuator damping means therein and an outer end portion having a substantially cylindrical channel formed therein to retain said actuator adjustment means therein.

7. The side-impact electro-mechanical accelerometer of claim 6 wherein said actuator damping means comprises a substantially annular damping member securely disposed within said recess of said inner end portion of said substantially tubular member.

8. The side-impact electro-mechanical accelerometer of claim 1 wherein said actuator comprises a substantially spherical member movable between a first, second and third position having a diameter substantially equal to that of said aperture to minimize oscillation or lateral movement of said actuator within said aperture.

9. The side-impact electro-mechanical accelerometer of claim 1 wherein said chamber has a diameter greater than a diameter of said aperture of said member.

10. The side-impact electro-mechanical accelerometer of claim 9 wherein said member is misaligned, along a longitudinal axis thereof, with the center of said actuator when said actuator is in said second and third configurations.

11. The side-impact electro-mechanical accelerometer of claim 1 further including a retention means to retain said actuator within said chamber for at least three milliseconds when said actuator is in said second and third configurations.

12. The side-impact electro-mechanical accelerometer of claim 11 wherein said retention means comprises a retention shoulder formed on said member to engage and momentarily retain said actuator within said chamber when said actuator is in said second and third configurations.

13. The side-impact electro-mechanical accelerometer of claim 11 wherein said first conductive switch element includes a proximal conductive section and a distal conductive section wherein said distal conductive section is configured to guide said actuator into said chamber when moving from said first position to said second and third positions.

14. The side-impact electro-mechanical accelerometer of claim 13 wherein said distal conductive section of said first conductive switch element includes a substantially concave end section.

15. The side-impact electro-mechanical accelerometer of claim 14 wherein said distal conductive section of said first conductive switch element includes a contact section to normally bias said actuator in said first configuration and terminates in a substantially concave end section.

16. The side-impact electro-mechanical accelerometer of claim 15 wherein said substantially concave end section engages said second conductive switch element when said actuator means is in said second configuration and said first conductive switch element is in said second position to complete said first electric circuit.

17. The side-impact electro-mechanical accelerometer of claim 15 wherein said distal conductive section of said second conductive switch element engages said third conductive switch element when said actuator means is in said third configuration and said second conductive switch element is in said third position to complete said second electric circuit.

18. The side-impact electro-mechanical accelerometer of claim 13 wherein said second conductive switch element includes a proximal conductive section and a distal conductive section and said member includes a first stop to engage said distal conductive section of said second conductive switch element when in said first position.

19. The side-impact electro-mechanical accelerometer of claim 13 wherein said third conductive switch element includes a proximal conductive section and a distal conductive section and said member includes a second stop to engage said distal conductive section of said third conductive switch element when in said first position.

20. The side-impact electro-mechanical accelerometer of claim 1 wherein said first conductive switch element includes a proximal conductive section and a distal conductive section wherein said distal conductive section includes an end section to momentarily retain said actuator in said chamber when said actuator is said second and third configurations.

21. The side-impact electro-mechanical accelerometer of claim 20 wherein said end section of said distal conductive section of said first conductive switch element is substantially concave.

22. The side-impact electro-mechanical accelerometer of claim 21 wherein said substantially concave end section of said first conductive switch element engages said second conductive switch element when said actuator means is in a second configuration and said first conductive switch element is in said second position to complete said first electric circuit.

23. The side-impact electro-mechanical accelerometer of claim 1 wherein said first conductive switch element includes a proximal conductive section and a distal conductive section wherein said distal conductive section includes a contact section to normally bias said actuator in said first configuration.

24. The side-impact electro-mechanical accelerometer of claim 23 wherein said second conductive switch element includes a proximal conductive section and a distal conductive section wherein said distal conductive section engages said third conductive switch element when said second conductive switch element is in said third position and said third conductive switch position is in said second position to complete said second electric circuit.

25. The side-impact electro-mechanical accelerometer of claim 1 wherein said first conductive switch element includes a proximal conductive section and a distal conductive section wherein said distal conductive section includes a substantially concave end section to momentarily retain said actuator in said chamber when moving from said first configuration to said second and third configurations, said second conductive switch element includes a proximal conductive section and a distal conductive section wherein said distal conductive section engages said first conductive switch element when said second conductive switch element is in said second position and said third conductive switch element includes a proximal conductive section and a distal conductive section wherein said distal conductive section engages said second conductive switch element when said third conductive switch element is in said second position.

26. The side-impact electro-mechanical accelerometer of claim 25 wherein said member includes a first stop to engage said distal conductive section of said second conductive switch element when in said first position.

27. The side-impact electro-mechanical accelerometer of claim 26 wherein said member includes a second stop to engage said distal conductive section of said third conductive switch element when in said first position.

28. A side-impact electro-mechanical accelerometer for use in a vehicle to close a first electric circuit when a lateral acceleration force greater than a first predetermined threshold level is sensed and to close a second electric circuit when a lateral acceleration force greater than a second predetermined threshold level is sensed comprising a hollow housing having an actuator means including an actuator and a track guiding means having a body with a recess formed therein to selectively receive said actuator therein; a chamber cooperatively formed by said hollow housing and said body wherein said actuator means is selectively operable in a first, second and third actuator configuration when said actuator is in a first, second and third position, respectively, such that said actuator is at least partially disposed in said housing when in said first position; and a switch means including a first conductive switch element movable between a first, second and third position disposed to engage said actuator in said first position, a second conductive switch element movable between a first, second and third position disposed in spaced relationship relative to said actuator means and said first conductive switch element in said first position and disposed to engage said first conductive switch element in said second position when the lateral acceleration force greater than the first predetermined threshold level is exerted on the side-impact electro-mechanical accelerometer to close said first electric circuit and a third conductive switch element movable between a first and second position disposed in spaced relationship relative to the second conductive switch element in said first position and to engage the second conductive switch element in said second position when a lateral acceleration force greater than the second predetermined threshold level is exerted on the electro-mechanical accelerometer to close said second electric circuit.

29. The side-impact electro-mechanical accelerometer of claim 28 wherein said track guiding means includes a track to guide said actuator between said first position and said second and third positions.

30. The side-impact electro-mechanical accelerometer of claim 29 wherein said track includes a substantially vertical seat to engage said actuator when in said first position and a travel aperture to receive at least a portion of said actuator when in said second position.

31. The side-impact electro-mechanical accelerometer of claim 30 wherein said actuator comprises a substantially spherical member movable between a first, second and third position having a diameter substantially equal in diameter to that of said travel aperture to minimize oscillation or lateral movement of said actuator while retained by said track.

32. The side-impact electro-mechanical accelerometer of claim 30 wherein said chamber has a diameter greater in diameter to that of said travel aperture of said track.

33. The side-impact electro-mechanical accelerometer of claim 32 wherein the aperture of said track is misaligned, along a longitudinal axis thereof, with the center of said actuator when said actuator is in said second and third positions.

34. The side-impact electro-mechanical accelerometer of claim 28 wherein said body comprises an inner end portion having said recess formed therein to retain said track guiding means therein.

35. The side-impact electro-mechanical accelerometer of claim 28 further including a retention means to retain said actuator within said chamber for at least three milliseconds when said actuator is in said second and third positions.

36. The side-impact electro-mechanical accelerometer of claim 35 wherein said retention means comprises a retention shoulder formed on said body to engage and momentarily retain said actuator within said chamber when said actuator is in said second and third positions.

37. The side-impact electro-mechanical accelerometer of claim 35 wherein said first conductive switch element includes a proximal conductive section and a distal conductive section wherein said distal conductive section is configured to guide said actuator into said chamber when moving from said first position to said second and third positions.

38. The side-impact electro-mechanical accelerometer of claim 37 wherein said distal conductive section of said first conductive switch element includes a substantially concave end section.

39. The side-impact electro-mechanical accelerometer of claim 38 wherein said distal conductive section of said first conductive switch element includes a contact section to normally bias said actuator in said first position and terminates in a substantially concave end section.

40. The side-impact electro-mechanical accelerometer of claim 39 wherein said substantially concave end section of said first conductive switch element engages said second conductive switch element when said actuator and said first conductive switch element are each in said second position to complete said first electric circuit.

41. The side-impact electro-mechanical accelerometer of claim 39 wherein said second conductive switch element includes a proximal conductive section and a distal conductive section wherein said distal conductive section engages said third conductive switch element when said second conductive switch element is in said third position to complete said second electric circuit.

42. The side-impact electro-mechanical accelerometer of claim 37 wherein said second conductive switch element includes a proximal conductive section and a distal conductive section and said body includes a first stop to engage said distal conductive section of said second conductive switch element when in said first position.

43. The side-impact electro-mechanical accelerometer of claim 42 wherein said third conductive switch element includes a proximal conductive section and a distal conductive section and said body includes a second stop to engage said distal conductive section of said third conductive switch element when in said first position.

44. The side-impact electro-mechanical accelerometer of claim 28 wherein said first conductive switch element includes a proximal conductive section and a distal conductive section wherein said distal conductive section includes an end section to momentarily retain said actuator in said chamber when said actuator is said second and third positions.

45. The side-impact electro-mechanical accelerometer of claim 44 wherein said end section of said distal conductive section of said first conductive switch element is substantially concave.

46. The side-impact electro-mechanical accelerometer of claim 45 wherein said substantially concave end section of said first conductive switch element engages said second conductive switch element when said actuator and said first conductive switch element are each in said second position to complete said second electric circuit.

47. The side-impact electro-mechanical accelerometer of claim 46 wherein said second conductive switch element includes a proximal conductive section and a distal conductive section wherein said distal conductive section engages said third conductive switch element when said second conductive switch element is in said third position and said third conductive switch position is in said second position to complete said second electric circuit.

48. The side-impact electro-mechanical accelerometer of claim 28 wherein said first conductive switch element includes a proximal conductive section and a distal conductive section wherein said distal conductive section includes a contact section to normally bias said actuator in said first position.

49. The side-impact electro-mechanical accelerometer of claim 28 wherein said first conductive switch element includes a proximal conductive section and a distal conductive section wherein said distal conductive section includes a substantially concave end section to momentarily retain said actuator in said chamber when moving from said first position to said second and third positions, said second conductive switch element includes a proximal conductive section and a distal conductive section wherein said distal conductive section engages said first conductive switch element when said second conductive switch element is in said second position and said third conductive switch element includes a proximal conductive section and a distal conductive section wherein said distal conductive section engages said second conductive switch element when said third conductive switch element is in said second position.

50. The side-impact electro-mechanical accelerometer of claim 49 wherein said body includes a first stop to engage said distal conductive section of said second conductive switch element when in said first position.

51. The side-impact electro-mechanical accelerometer of claim 50 wherein said body includes a second stop to engage said distal conductive section of said third conductive switch element when in said first position.

* * * * *